United States Patent [19]

Hirst et al.

[11] Patent Number: 4,807,868

[45] Date of Patent: Feb. 28, 1989

[54] SHEET TRANSPORT

[75] Inventors: Ian Hirst, Royston; John R. Strutt, Shefford, both of United Kingdom

[73] Assignee: Xerox Corporation, Stamford, Conn.

[21] Appl. No.: 534,004

[22] Filed: Sep. 20, 1983

[30] Foreign Application Priority Data

Sep. 21, 1982 [GB] United Kingdom ..... 8226816

[51] Int. Cl.[4] ..... B65H 7/00

[52] U.S. Cl. ..... 271/256; 271/162; 271/263

[58] Field of Search ..... 271/272–274, 271/4, 9, 10, 157, 162, 164, 253, 258, 259, 34, 35, 122, 125, 256, 257, 121

[56] References Cited

U.S. PATENT DOCUMENTS

| | | | |
|---|---|---|---|
| 3,301,551 | 1/1967 | Cassano et al. | 271/170 |
| 3,599,966 | 8/1971 | Del Vecchio et al. | 271/9 |
| 3,603,680 | 9/1971 | Barton | 271/259 X |
| 3,689,064 | 9/1972 | Kuksa | 271/164 |
| 3,981,493 | 9/1976 | Klappenecker et al. | 271/10 |
| 4,113,245 | 9/1978 | Colglazier et al. | 271/121 |
| 4,223,323 | 6/1981 | Kaneko et al. | 271/164 |
| 4,299,382 | 11/1981 | Ichikawa | 271/258 X |
| 4,335,950 | 6/1982 | Gunzelmann et al. | 271/273 X |
| 4,387,889 | 6/1983 | Koyama et al. | 271/274 X |

FOREIGN PATENT DOCUMENTS

| | | |
|---|---|---|
| 907587 | 10/1962 | United Kingdom . |
| 918008 | 2/1963 | United Kingdom . |
| 1583168 | 4/1977 | United Kingdom . |
| 1469441 | 1/1981 | United Kingdom . |
| 2069468 | 8/1981 | United Kingdom . |

*Primary Examiner*—Joseph J. Rolla
*Attorney, Agent, or Firm*—William A. Henry, II

[57] ABSTRACT

A sheet transport includes one or more drive nips and a mechanism for automatically disengaging the nips in response to a predetermined condition such as the sensing of a jammed or stalled sheet, the movement of a sheet delivery tray between a sheet feeding position and a retracted position or the opening of an access door to the sheet transport. In a preferred form, one element of each drive nip is moved from the other element on a pivoted mounting.

4 Claims, 13 Drawing Sheets

Figure 1:
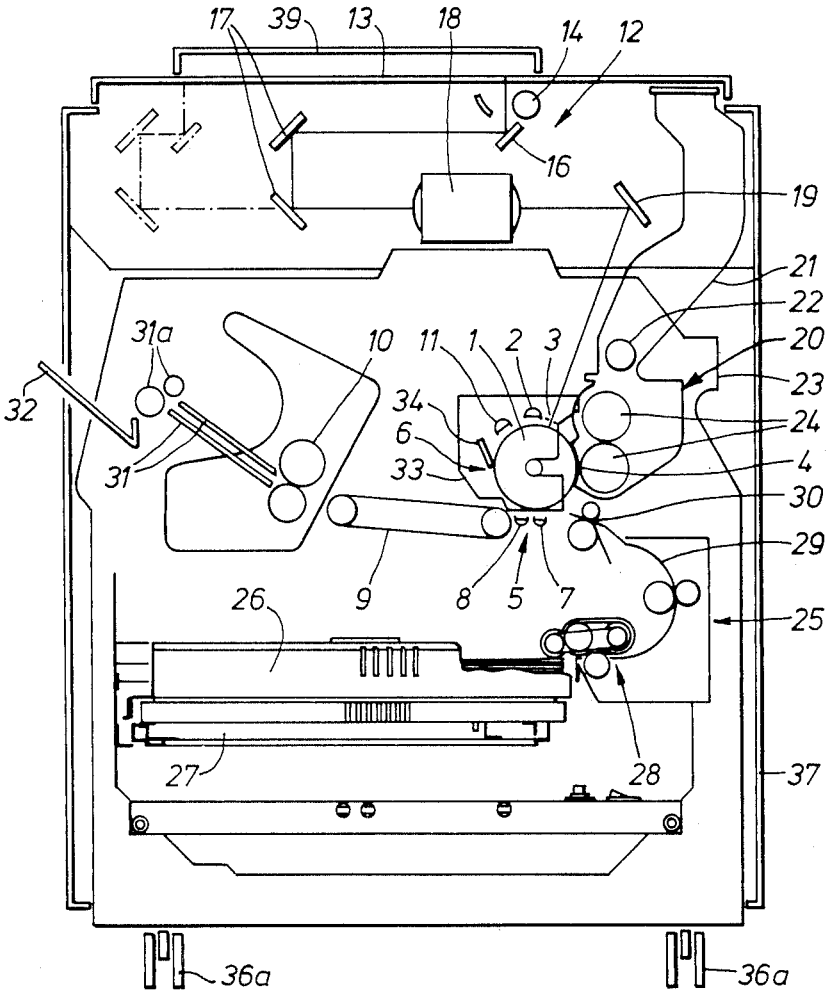

41
42
41
65
40
64
63
45
43
74
46
48
49
44
47
61
26
27
62
60
51
56
59
58
52
57
68
66
53
50
54
67
70
55
71
73
72

Fig. 14.
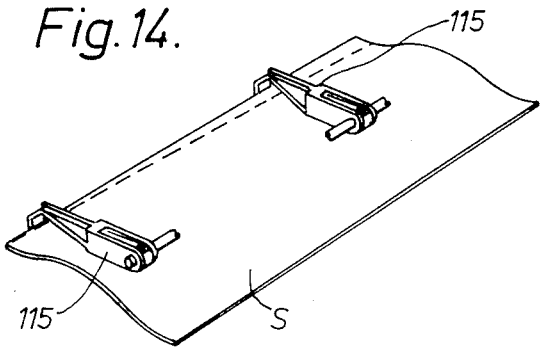
Fig. 15.
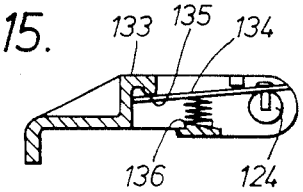
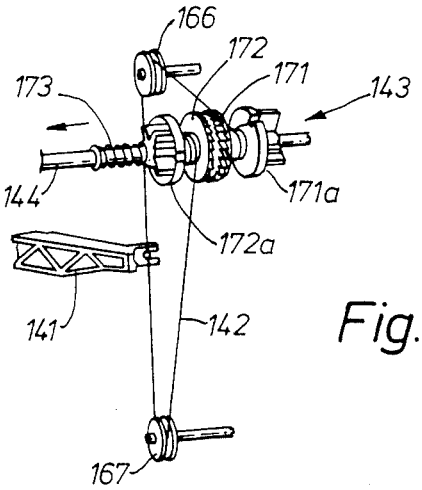
Fig. 21.

SHEET TRANSPORT

This invention relates to sheet transports including one or more drive nips and to photocopiers incorporating such sheet transports.

Sheet transports of the kind in which the sheets are conveyed by drive nips spaced along the transport path are widely used for example in photocopiers. Although such transports are designed to avoid so far as possible the jamming or stalling of sheets, this is inevitable. The drive nips usually grip the sheets firmly in order to exercise the necessary directional and speed control and when a sheet jams or stalls in a nip it must be withdrawn from the nip. In some copiers the sheets must be withdrawn by pulling them out of the nip but this can lead to the sheets tearing increasing the difficulty of removing them. In other copiers the nips can be manually disengaged or disassembled. Such arrangements, however, can be awkward or inconvenient for the user.

A sheet transport according to the present invention has means for automatically engaging the drive nip(s) in response to a predetermined condition, for example the sensing of a jammed or stalled sheet.

Where the sheet transport is incorporated in a copier having a housing and a door in said housing for obtaining access to the sheet transport for removing sheets therefrom, the disengaging means may be actuated in response to opening of the door.

In a sheet transport including a tray for sheets to be fed which is movable between a sheet feeding position and a retracted position, movement of the tray towards said retracted position may actuate the disengaging means.

The tray may move to its retracted position in response to the sensing of a jam or the opening of a door as described above.

Sheet transport arrangements are also known in which two trays are separately engageable with a common sheet feeder and movable between positions in which they are respectively engaged with and retracted from the sheet feeder and possibly also a position in which both trays are retracted. In such case the disengaging means may be actuated by either of the trays being retracted.

The disengaging means may be mechanically linked to a movable tray as described above, preferably through a lost motion mechanism so that the disengaging means is actuated during a fixed travel of the tray. Thus the disengaging means may comprise a cam linked to the tray through a cable drive including a wrap-spring clutch.

The nip(s) suitably comprise first and second coating drive members, e.g. rolls, resiliently biassed together, one of the members being retractable against said bias by the disengaging means.

When feeding sheets using a mechanical feeder there is a tendency for sheets to be multifed in groups of two or more due to frictional and binding forces between the sheets. In order to ensure that sheets are fed one at a time retard feeders are employed in which sheets are advanced into the nip between a driven sheet advancing member, such as a belt or roll, and a stationary friction or retard member, which coact such that a first sheet in contact with the driven member will be advanced but other sheets also in the nip area will be retarded by the stationary friction member. Disengaging such a nip in the manner of this invention enables a partly fed sheet or sheets held in the nip to be returned to the tray when changing trays in a multi-tray arrangement as described above.

Figure 2:
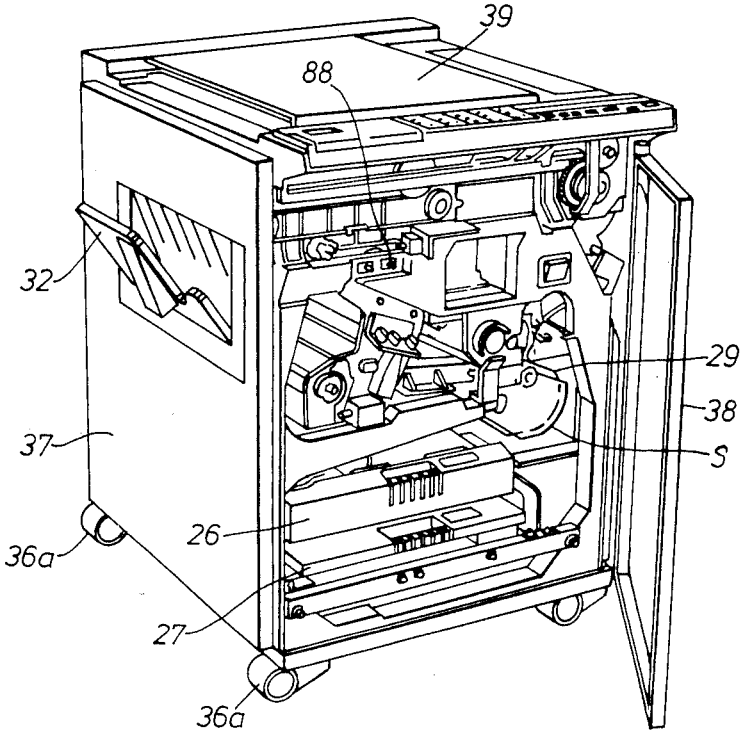
Figure 3:
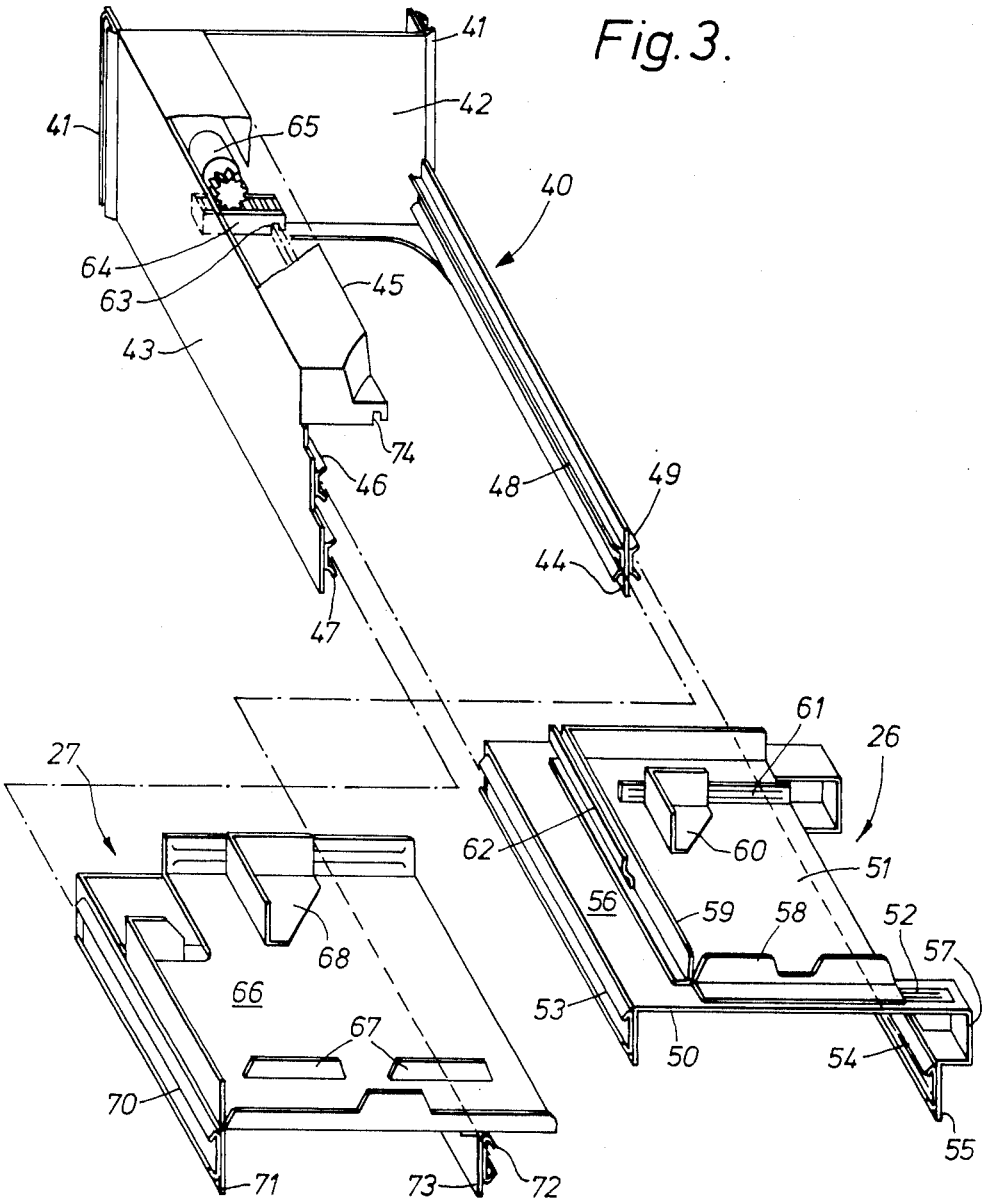
Figure 4:
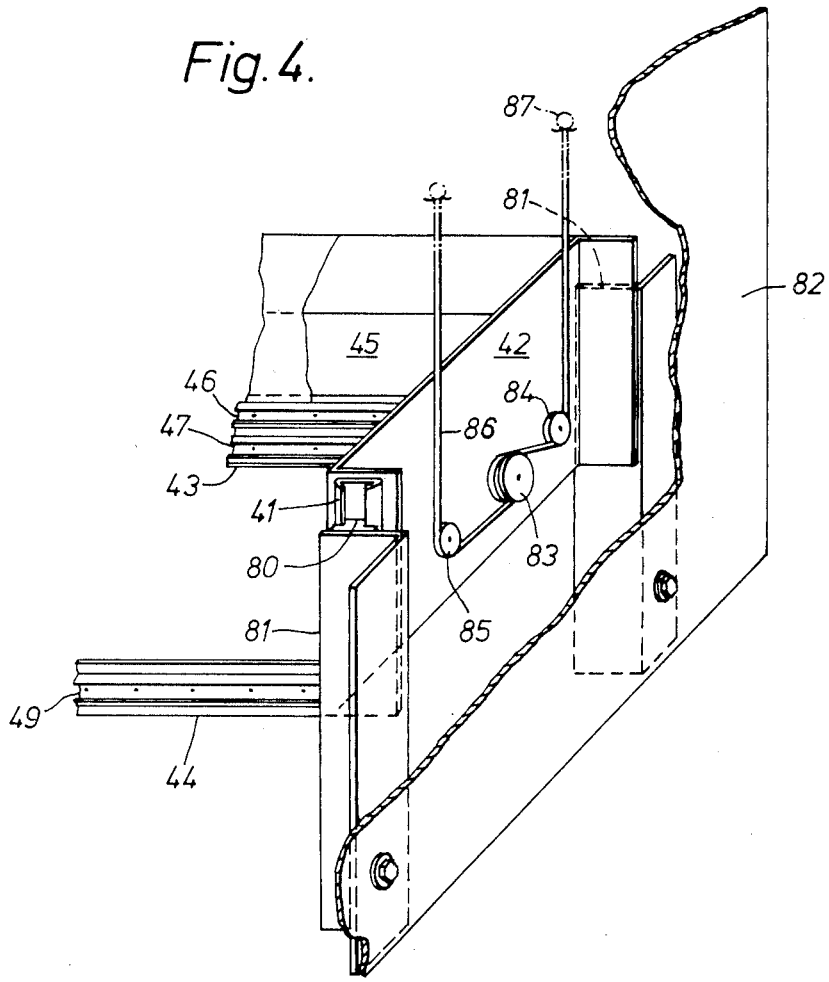
Figure 5:
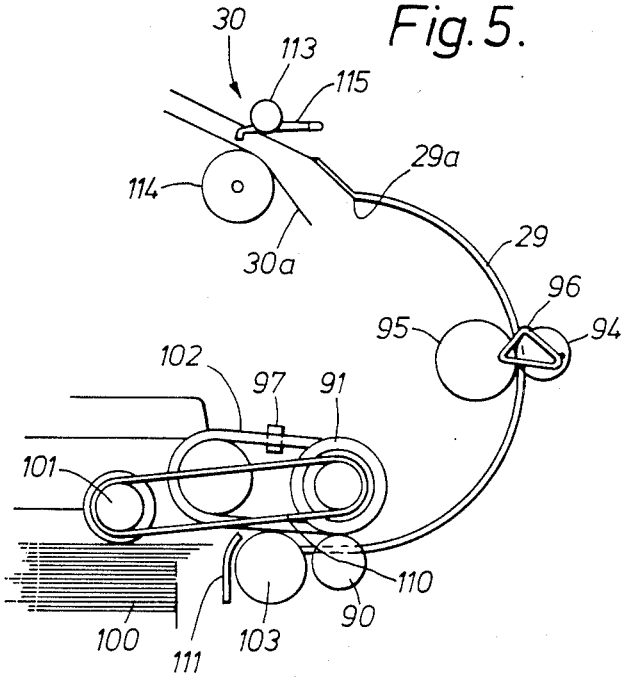
Figure 9:
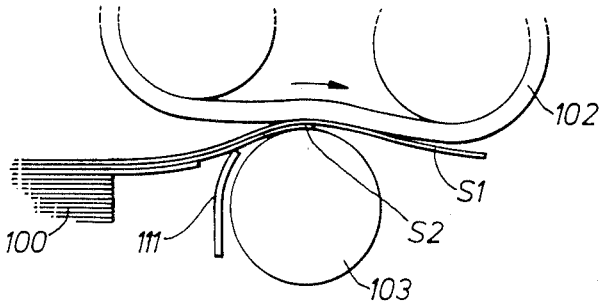
Figure 6:
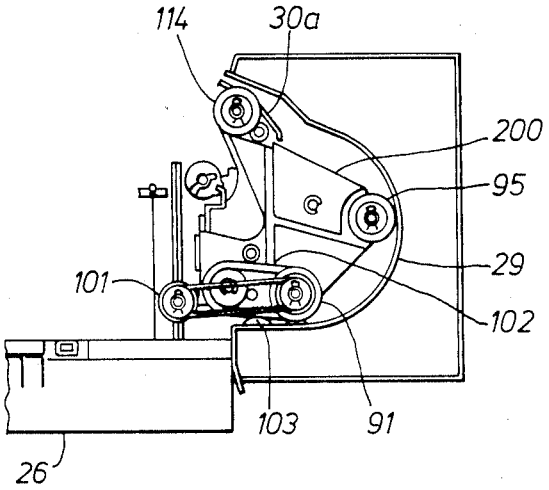
Figure 7:
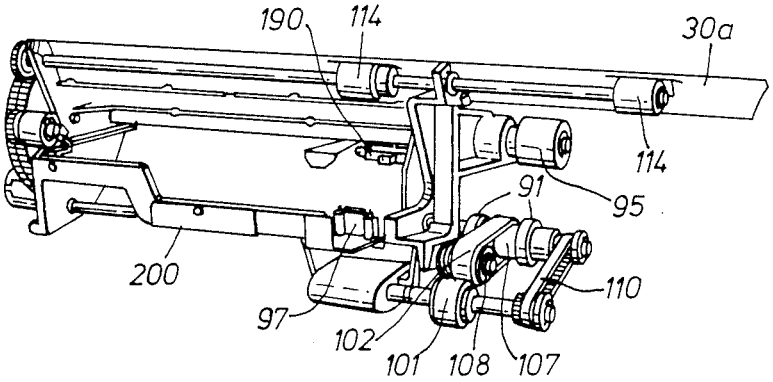
Figure 8:
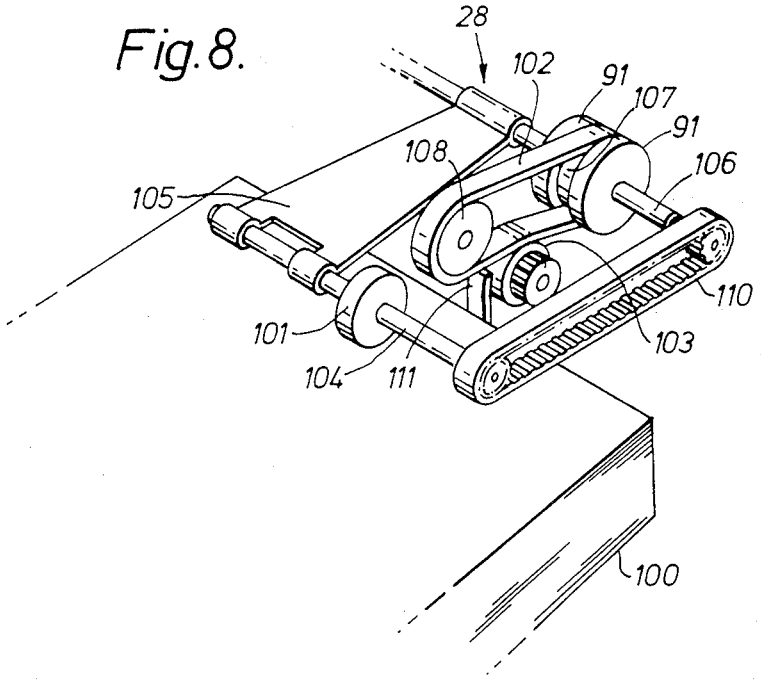
Figure 10:
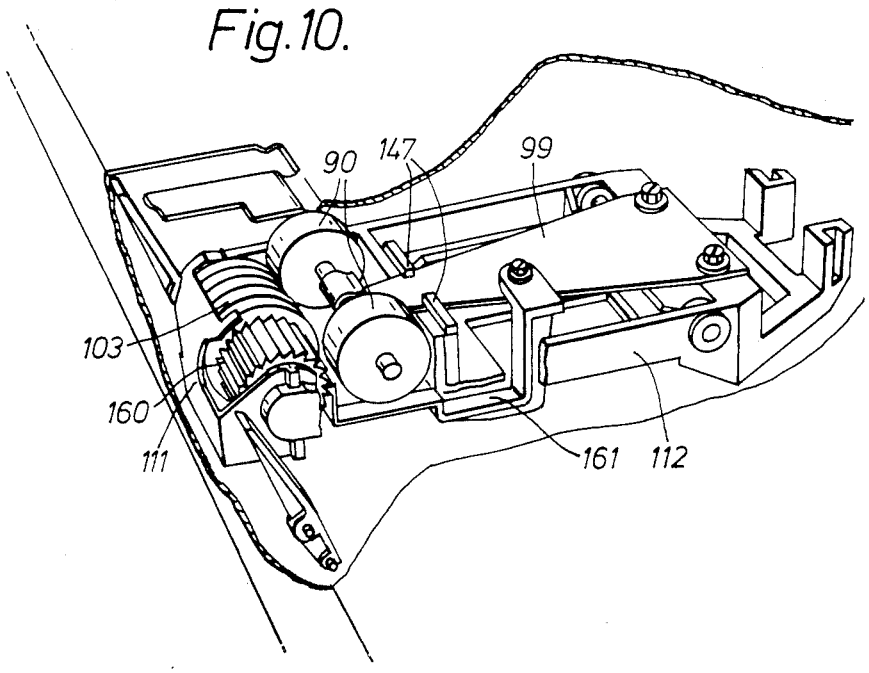
Figure 11:
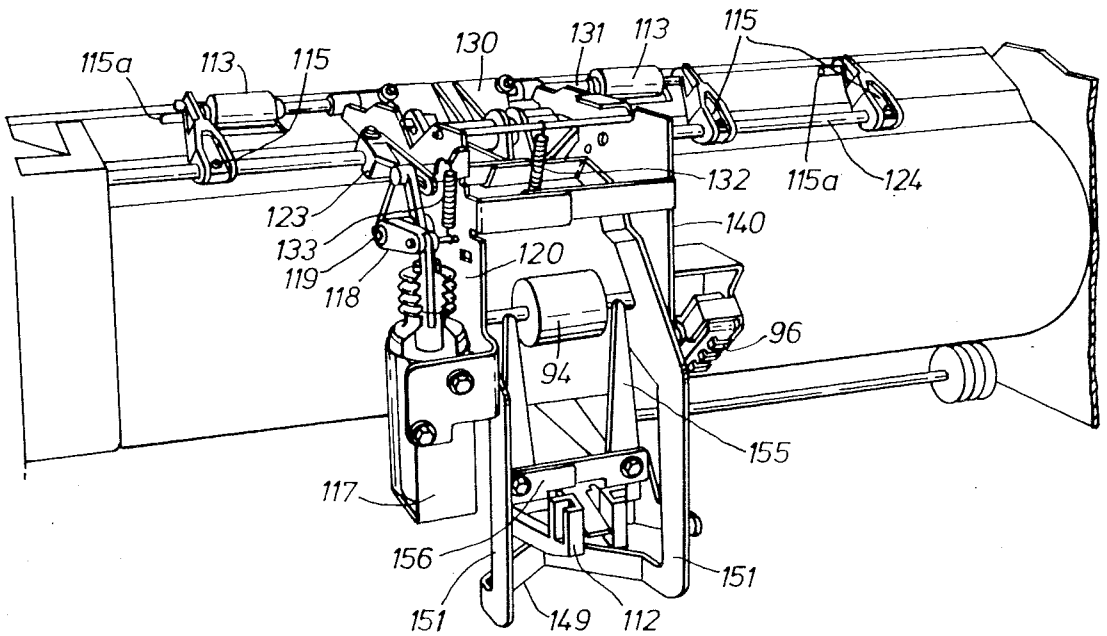
Figure 12:
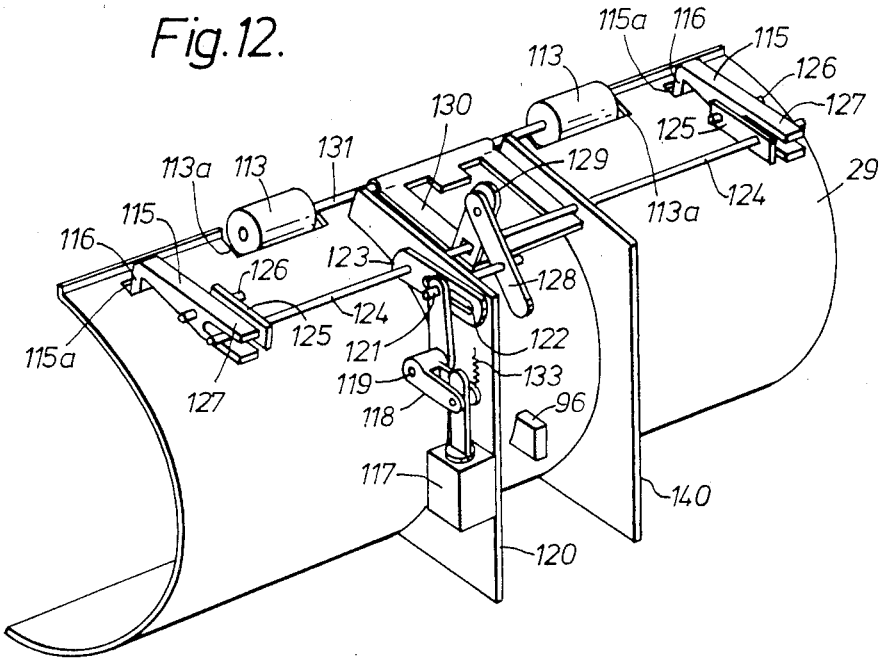
Figure 13:
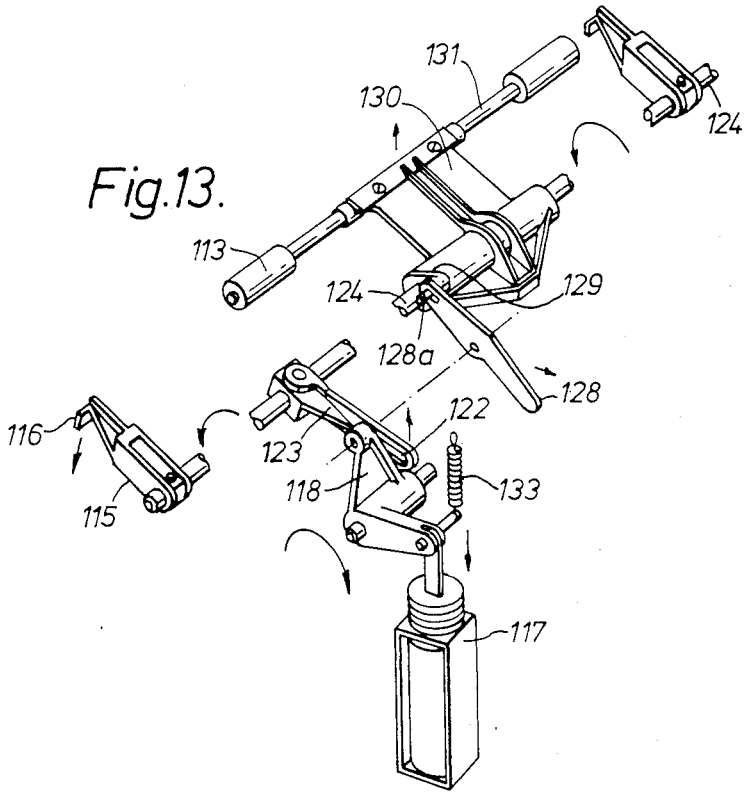
Figure 16:
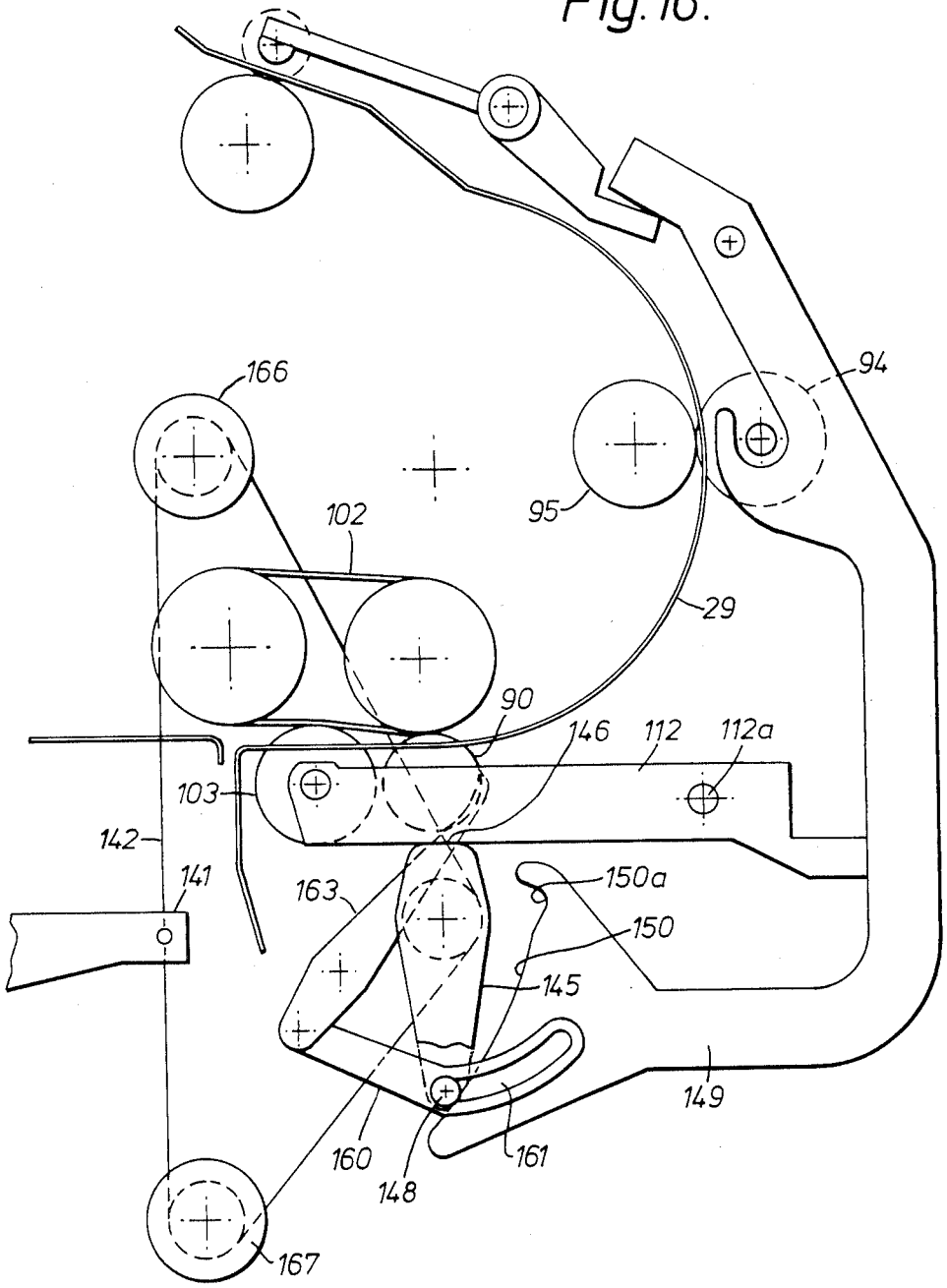
Figure 17:
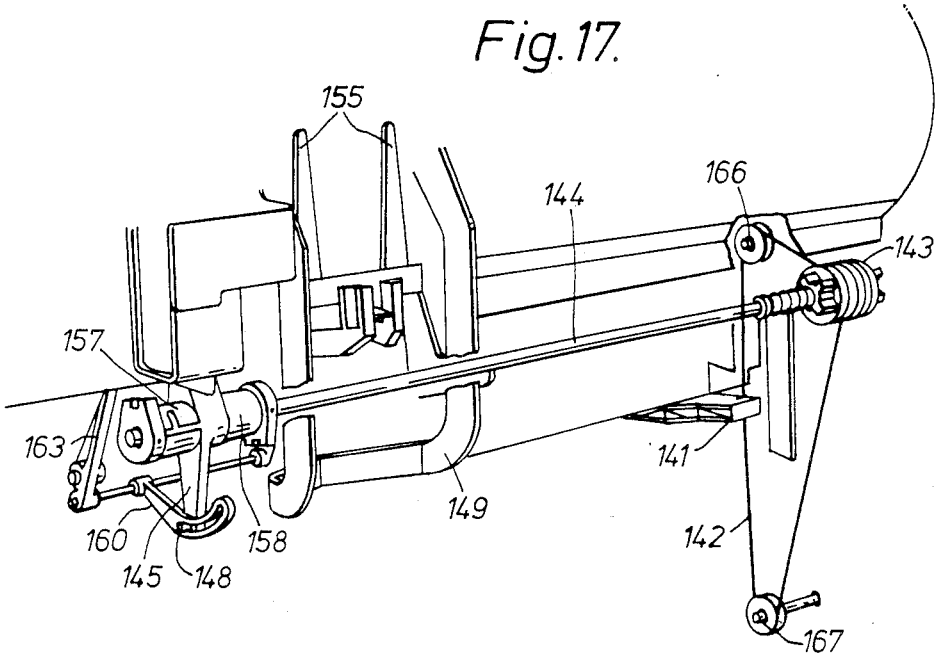
Figure 18:
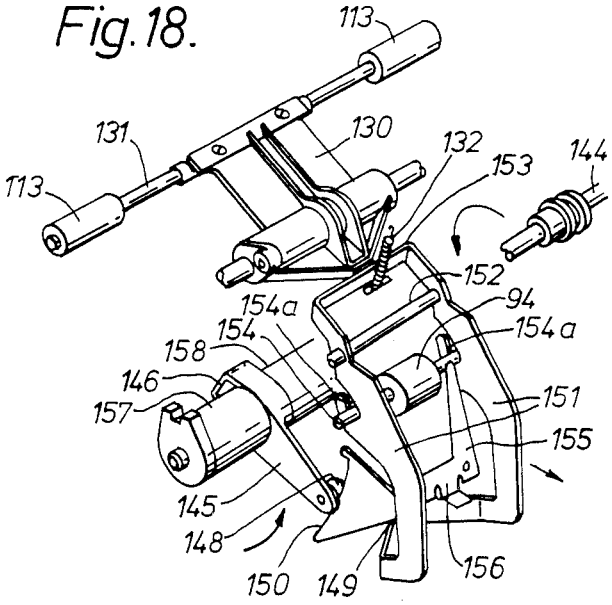
Figure 19:
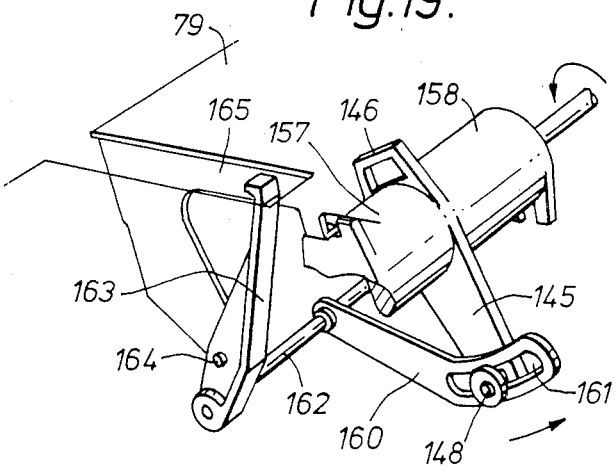
Figure 20:
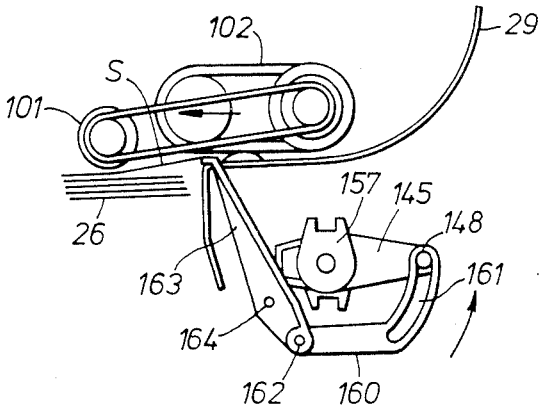

In order that the invention may be more readily understood, reference will now be made to the accompanying drawings, in which:

FIG. 1 is a schematic side elevational view of a photocopier incorporating the present invention showing the operational elements thereof, FIG. 2 is a perspective view from the front of the photocopier with the front access door open, FIG. 3 is a schematic, exploded perspective view of the sheet tray arrangement, FIG. 4 is a partial perspective view of the paper tray arrangement showing the lifting mechanism, FIG. 5 is a schematic side elevation of the sheet delivery transport from the sheet trays to the photoreceptor by which the direction of the sheets is reversed, FIG. 6 is a view like that of FIG. 5 showing the manner of mounting the sheet delivery transport, FIG. 7 is a perspective view of the mounting arrangement, FIG. 8 is a schematic perspective view of a retard roll sheet feeder for feeding sheets from the sheet trays, FIG. 9 is a scrap view of the sheet feeder illustrating the operation thereof, FIG. 10 is a perspective view of the retard roll assembly of the sheet feeder of FIG. 8, FIG. 11 is a perspective view from the back of the sheet reversing transport showing mechanism for registering sheets at the output end of the transport and for separating the drive nips of the transport to facilitate removal of jammed sheets, FIG. 12 is a view similar to FIG. 11 showing the registration mechanism, FIG. 13 is a partly broken away view of the elements of the registration mechanism illustrating their operation, FIGS. 14 and 15 show details of the registration mechanism, FIG. 16 is a schematic side elevation of the sheet reversing transport showing the registration and nip separation mechanisms, FIG. 17 is a partial view of the nip separation mechanism, FIG. 18 shows another partial view of the nip separation mechanism, FIG. 19 shows another detail of the nip separation mechanism also illustrating a mechanism for restacking sheets in the sheet trays, FIG. 20 is a side elevation of the restacking mechanism, and FIG. 21 shows a further detail of the nip separation mechanism.

Referring first to FIG. 1 there is shown a xerographic copying machine incorporating the present invention. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corotron 7 provides an electric field to assist in the transfer of the toner particles thereto. The copy sheet is then stripped from the drum 1, the detachment being assisted by the electric field provided by an a.c. de-tack corotron 8. The copy sheet carrying the developed image is then carried by a transport belt system 9 to a fusing station 10.

After transfer of the developed image from the drum, some toner particles usually remain on the drum, and these are removed at the cleaning station 6. After cleaning, any electrostatic charges remaining on the drum are removed by an a.c. erase corotron 11. The photoreceptor is then ready to be charged again by the charging corotron 2, as the first step in the next copy cycle.

The optical image at imaging station 3 is formed by optical system 12. A document (not shown) to be copied is placed on platen 13, and is illuminated by a lamp 14 that is mounted on a scanning carriage which also carries a mirror 16. Mirror 16 is the full-rate scanning mirror of a full and half-rate scanning system. The full-rate mirror 16 reflects an image of a strip of the document to be copied onto the half-rate scanning mirrors 17. The image is focussed by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image of the drum in sharp focus throughout the scan.

At the development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and the toner, which is brought into developing engagement with drum 1 by a two-roller magnetic brush developing arrangement 24.

The developed image is transferred, at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet separator/ feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is heated roll fuser. The image is fixed to the copy sheet by the heat and pressure in the nip between the two rolls of the fuser. The finaly copy is fed by the fuser rolls along output guides 31 into catch tray 32, which is suitably an offsetting catch tray, via output nip rolls 31*a*.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger.

As shown in FIG. 2, the elements of the copier are carried by a frame 36 and are all enclosed by a cover 37 having a front acces door 38, except for the catch tray 32 which protrudes through the side cover. The copier is mounted on castors 36*a*. The platen 13 is covered by a hinged cover 39 which can be raised from access to the platen. The cover 39 may incorporate a semi-automatic document handler by which copies inserted manually at one side are automatically fed onto the platen for copying and then fed off the platen after copying, or an automatic recirculating document handler by which documents arranged in a stack are fed on to the platen one at a time for copying and then returned to the stack after copying. The copier may also have a sorter or finisher arranged to receive copies from the output nip rolls 31*a*.

As mentioned above, sheets S may be fed from either the main tray 26 or the auxiliary tray 27. The auxiliary tray is of larger size than the main tray, enabling a wide choice of paper sizes and types to be fed from it. The trays are physically located in the lower part of the machine below the photoreceptor drum 1.

The paper trays will now be described in more detail with reference to FIGS. 3 and 4. The trays are mounted on a tray carriage 40 for delivering paper to the right as seen in FIG. 2. As shown by the broken lines on FIG. 2, the main tray 26 is the upper tray and the auxiliary tray 27 is the lower tray.

The tray carriage 40 is supported entirely by means of vertical ball slides 41, the moving parts only of which are shown in FIG. 3, the cooperating, fixed, parts being mounted on the rear frame of the machine. The ball slides 41 allow the tray carriage to move vertically up and down as will be described in more detail later (with reference to FIG. 4).

The tray carriage 40 consists of a vertical rear plate 42, a left-hand side plate 43, and a right-hand side plate 44. The left-hand side plate 43 carries a box-like container 45 along the upper part of the tray carriage 40, for housing electrical components, including an electric motor. An upper left-hand slide rail 46 and a lower left-hand slide rail 47 are mounted below the container 45, and extend from front to rear of the left-hand side plate 43. The right-hand side plate 44 carries an inner right-hand slide rail 48 and an outer right-hand slide rail 49 which both extend from front to rear of the right-hand side plate 44, and are both at the same height as the lower left-hand slide rail 47.

The main tray 26 comprises a main tray sub-frame 50 and a main paper support tray 51. The main paper tray 51 is mounted for left-to-right sliding movement over the main tray sub-frame 50 by means of a ball slide 52 at the front of the tray, the rear part of the paper tray 51 sliding over Nylon studs (not shown) in the sub-frame 50. The sub-frame 50 carries, on a downward extension of its left-hand edge, a left-hand slide 53 for cooperation with the upper left-hand rail 46 of the tray carriage 40, and, on a support plate 55, a right-hand slide 54 for cooperation with the outer right-hand rail 49. The rail 49 for the right-hand slide 54, as mentioned above, is at the same level as the rail 48 which as explained below supports a right-hand slide 72 for the lower tray 27. In order to permit sheets to be fed towards the right from the lower tray 27 the support plate 55 is spaced below the base plate 56 of the main tray sub-frame 50 on extension pieces 57.

The main paper tray 51, which feeds paper to the right, has an upstanding front wall 58 and a left-hand side wall 59. Sheets are registered against front wall 58 by a movable corner piece 60 which is mounted for left-to-right sliding movement on a slide 61, which is itself mounted for front-to-back sliding movement on a slide (not shown). On the left-hand side wall 59, an elongated catch member 62 is formed, with an upstanding outer portion that extends from about the mid-portion to the rear end portion of the side wall 59. The upstanding outer portion of the catch member 62 is for engagement with a notch 63 in a rack 64 that is mounted for sliding left-to-right movements in the container 45. The rack is engaged by a pinion that is driven by a motor 65. When the main tray 26 is in the 'home' position in the tray carriage 40, i.e. when it has been slid to the rear of the carriage 40 as far as it will go, the upstanding outer portion of catch member 62 engages in notch 63, enabling the motor 65 to drive the paper tray 51 to the left or the right over the base plate 56 which is cut away at the right-hand side as seen in FIG. 2 to permit elevation of the tray 26 above the feeder 28 when feeding from the lower tray 27.

In order to prevent the main paper tray 51 from moving to the right other than when it is in its 'home' position, a groove 74 is formed along the right-hand vertical side of the container 45. Groove 74 extends from the front of the container 45 to a point approximately midway between the front and rear of container 45, terminating just in front of the rack 64. The upstanding portion of catch member 62 and the groove 74 are arranged such that during withdrawal and re-insertion of the main tray 1, catch member 62 and groove 74 are slidingly interlocked. Once the main tray 26 is fully home, however, catch member 62 has passed completely through groove 74, and is engaged only by notch 63 of rack 64.

The auxiliary tray 27 includes a platform 66 for supporting copy paper sheets between upstanding front plates 67 and a slideable corner piece 68. Sheets are registered against the front plates 67 by moving the corner piece 68 which is arranged for left-to-right sliding on slide 69, which is itself arranged for back-to-front sliding on a slide (not shown). A left-hand slide 70 is carried by a downwardly extending side plate 71 at the left-hand edge of the platform 66, and a right-hand slide 72 is carried by a downwardly extending plate 73 mounted inwardly of the right-hand edge of platform 66. Left-hand slide 70 cooperates with the lower left-hand rail 47 of the tray carriage 40, and the right-hand slide 72 cooperates with the inner right-hand rail 48 of carriage 40.

Referring now to FIG. 4, the mechanism for raising and lowering the tray will be described. The vertical slides 41 cooperate with rails 80 that are secured by angled members 81 to the rear frame 82 of the machine. Mounted on the rear panel 42 of the carriage 40 are a capstan 83, driven by a motor (not shown) on the front side of rear panel 42, and two pulleys 84, 85. A cable 86 is secured at one end by an anchorage 87 on the machine frame, generally vertically above the highest point reached by the pulley 84. The cable passes around pulley 84, is wound around capstan 83, passes around pulley 85, and is anchored to the machine frame in the same way as the other end. On energising the motor to turn capstan 83, the carriage 40 is elevated or lowered as the cable winds onto or off the capstan.

Copy paper sheets can be fed out from either tray at the choice of the operator. If sheets are to be fed from the main tray, the main paper tray 51 is moved to the right over the main tray sub-frame 50 by means of motor 65. The tray carriage 40 is elevated to bring the top right-hand edge of the stack of sheets in the main paper tray 51 into the feeding position relative to the paper feeder 28. If sheets are to be fed from the auxiliary tray 27, the main tray 51 is moved to the left over the main tray sub-frame 50, and the tray carriage 40 is elevated to bring the top right-hand edge of the stack of sheets in the auxiliary paper tray into the feeding position. In order to change back to the main tray, the tray carriage 40 is lowered, the main tray is moved again to the right, and the tray carriage 40 is elevated again.

When replenishment of either tray is required, the tray in question may be simply pulled out, on its slides, to the front of the machine. This is only permitted once the main tray 51 has been moved fully to the left and the trays have been lowered from the feed position. In order to load paper, the operator will open the front door, which will break the machine interlock (switch 88) and send a signal by way of the machine logic to the motor which elevates and lowers the tray carriage 40. Energisation of the motor will cause the cable 86 to unwind, allowing the trays to descend under gravity until the tray carriage 40 actuates a down limit switch. When this limit switch is actuated, a signal is sent to the motor 65, causing the main tray 51 to be moved fully to the left. The trays then come to rest, and either one of them can be withdrawn by the operator. The operator will load paper towards the front right-hand corner of the required tray, and set the inboard corner piece 60 or 68 to lock the paper in position. In the front right-hand corner of each tray, there is a sheet registration corner piece, which is moved out of the way whenever the tray is inserted into the machine.

On closing the front door of the machine, the interlock 88 is remade, and on selection of a paper tray, the required tray is moved into the feed position. When the machine is in the standby mode, it is always set to feed paper from the main tray. This is achieved by a time-out feature that resets the machine to the main tray mode if no copies are made within 90 seconds of completing the previous job, A tray interlock system (not shown) is provided to prevent the operator from pulling the trays out of the machine unless they are in the proper position (as described above), or from pulling out both trays together when they are in the proper position.

As best seen in FIG. 5, the sheet transport to the photoreceptor comprises the sheet separator/feeder 28 which includes feed rolls 90, 91 which drive the sheet around the reversing guide 29 and into registration nip 30, which is arranged directly over the feeder 28 and includes nip rolls 113, 114, via take-away nip rolls 94, 95 arranged approximately mid-way between the feed rolls 90, 91 and the registration nip 30. Operation of the transport is initiated by the machine logic and controlled by an input microswitch 96 arranged at the nip rolls 94, 95. Further control of sheet feeding is achieved by use of a wait-station sensor 97 at the sheet feeder 28 as described below.

The photoreceptor 1 is arranged directly over the sheet trays 26, 27 so that in travelling to the photoreceptor drum the direction of travel of the sheets must be reversed. This is achieved by the sheet reversing guide 29 which turns the sheets leaving the trays 26, 27 through 180° so that they travel past the photoreceptor from right to left, and are incidentally inverted. As will be seen from FIGS. 1 and 5 the reversing guide 29 consists only of an outer, curved surface and spaced drive rolls for conveying sheets along the surface. In the embodiment illustrated the guide is formed from a single piece of sheet metal bent into generally semi-cylindrical form with a radius of curvature between 40 mm and 60 mm, preferably 56mm. The drive arrangement shown consists of an input drive nip (feed rolls 90, 91 at the exit of the sheet feeder 28), an output drive nip (registration nip rolls 113, 114) and only one intermediate drive nip (take-away rolls 94, 95). The intermediate drive nip 94, 95 ensures that the distance between drive nips is not greater than the dimension in the direction of sheet travel of the smallest sheet to be transported. It has been found that with such a sheet-reversing arrangement as just described it is not necessary to have an inner guide surface as the sheets being transported are fully supported by the sharply curved outer guide surface 29.

As clearly seen in FIG. 2, the sheet transport 25 to the photoreceptor is accessible at the front side through the open door 38. In order to facilitate the removal of stalled or jammed sheets from this transport, it provides a paper path which is accessible through the front edge of the transport throughout its length from the feeder 28 to the nip 30. This is achieved by mounting all the elements of the transport on the inner side of the sheet path from behind the paper path only by mounting them in cantilever fashion off the rear frame of the copier as illustrated in FIGS. 6 and 7. As shown, the elements on the inner side of the paper path, viz. the belt 102, nudger 101 and feed rolls 91 of the feeder 28, the intermediate feed roll 95 and the drive rolls 114 and guide **30*a* of the registration nip 30, are all carried in a frame 200** which is secured at its rear end only to the rear frame of the copier. This arrangement as well as the absence of an inner guide greatly enhances access to the paper path.

The removal of stalled or jammed sheets from the sheet delivery transport is further facilitated by conveying the sheets along the surface 29 so that they overlap the surface 29 at the front side as seen in FIG. 2. This is achieved by ensuring that the front side edges of sheets in the trays 26, 27 lie forward of the front edge of surface 29 by an amount equal to the overlap required. The amount of overlap is preferably about 20 mm. In the embodiment illustrated the sheets are registered in the paper trays against the registration edges 58, 67 at the fronts of the trays 26, 27 respectively, so that the amount of overlap will be substantially the same for all sheets regardless of their size.

Sheet separator/feeder 28 is a friction retard top sheet feeder of the belt-on-roll type and will now be described with particular reference to FIGS. 5, 6 and 7. Sheets S are fed from a stack 100 which is brought, by the positioning of the selected paper tray 26 or 27 as already described, into the feeding position. The top sheet in the stack is engaged by a nudger wheel 101, which on rotation feeds the top sheet towards the nip formed between a feed belt 102 and a retard roll 103.

Feeding from the paper trays by the nudger wheel 101 is obtained by creating a stack normal force (e.g. of 1.5 newtons) between the nudger wheel and the paper stack. This force is achieved by the weight of the nudger wheel and its associated components acting under gravity. The nudger wheel 101 is mounted on an axle 104 which is mounted for rotation in a weighted suspension arm 105. Suspension arm 105 is in turn mounted for angular motion about a fixed shaft 106 that is spaced from the axle 104.

The feed belt 102 is an endless belt arranged around a drive pulley 107 and an idler pulley 108. The belt 102 is deflected from below on its lower run by the retard roll 103 which is pressed against the belt.

Drive pulley 107 is secured to the shaft 106 which is driven through a feed clutch in the machine drive system. The axle 104 of the nudger wheel 101 is driven from shaft 106 by means of a toothed belt 110.

As paper is being fed from the stack 100, the paper tray 16 or 27 will elevate approximately 1 mm for every 10 sheets of 80 gsm paper being fed. This is sensed by a microswitch 190 (FIG. 7) which is operated by the suspension arm 105 of the nudger wheel, which determines the relative position of the paper stack to the feeder.

At the beginning of a print cycle, the machine logic will interrogate the system to determine if any paper is in the paper path. If there is no paper (as in FIG. 5) the logic will initiate a signel to the feed clutch, thereby starting the feeder. The nudger wheel 101 will drive the top sheet of paper in stack 100 into the nip between feed belt 102 and retad roll 103. The feed belt is made of soft rubber material with a high friction surface. As the feed belt 102 rotates it drags a sheet of paper from the stack. Frictional forces and static electricity between the sheets of paper in the stack may cause several sheets to move into the nip together.

If several sheets of paper approach the nip together, the friction between the retard roll 103 and the bottom sheet of those being fed is greater than that between two sheets. The friction between the feed belt 102 and the top sheet S1 is also greater than the friction between two sheets. The group of sheets being fed towards the nip will therefore tend to become staggered around the curved surface of the retard roll up into the nip, until the lower sheet S2 of the top two sheets is retained by the retard roll 103, while the topmost sheet is fed by the feed belt 102. Of course, in order for this to happen, the friction between the feed belt 102 and a paper sheet must be greater than the friction between a paper sheet and the retard roll 103. Therefore the feed belt 102 drives the top sheet S1 away from the stack, and the next sheet S2 is retained in the nip to be fed next (as in FIG. 9).

A lead-in baffle or shield 111 extends in front of the retard roll 103, and serves both to guide paper into the nip, and to prevent undue wear of the retard roll by sheets fed from the top of the stack by the nudger wheel.

The feed clutch remains energised (i.e. the feeder mechanism continues to operate) until paper is sensed by the input microswitch 96 located about halfway around the guide 29. Paper whose leading edge has reached this switch 96 is under the control of the takeaway rolls 94, 95 that drive the sheet until its leading edge enters registration nip 30 at the exit of the outer guide 29.

The surface speed of the feed belt 102, at the interface with the retard roll 103, is approximately 20% faster than the machine process speed, but due to friction losses between the belt, paper and retard roll, the paper speed is approximately equal to the process speed. The friction losses are not, of course, constant, since they tend to vary with paper weight, size and surface finish.

As shown in FIG. 10 the retard roll 103 and shield 111 are carried on a mounting block 112 which is operationally positioned so that the retard roll 103 is held against the underside of the belt 102. The block 112 is pivotally mounted for rotation about an axis 112*a* for retracting the retard roll 103 from the belt 102 as explained below.

The guide 29 includes a shaped portion 29*a* adjacent the registration nip 30 which encourages a slight downward buckle in sheets being registered as explained in detail below.

In order to obtain a constant speed for sheets leaving the feeder, they are advanced from the feeder by the take-away nip rolls 90, 91. As seen in FIGS. 8 and 10, these comprise a pair of drive rolls 91 mounted on the shaft 106 on opposite sides of the drive pulley 107 and a pair of coacting pressure rolls 90 carried by one end of a leaf spring 99 which urges the rolls 90 against rolls 91. The spring 99 has its other end secured to the block 112 which also supports the retard roll 103. The diameter of the driven feed rolls 91 is greater than the diameter of the feed belt 102. Thus the feed rolls drive the paper faster than the feed belt. The feed belt drive pulley 107 contains a one-way clutch which prevents the feed belt from causing drag.

Sheets from the feeder 28 are forwarded by the takeaway rolls 94, 95 to the registration nip 30. The purpose for registering sheets at the nip 30 is to enable each sheet to be released on the photoreceptor in synchronism with the developed image on the photoreceptor drum. In addition, registration is used to remove any skew from the sheet. Perspective and partial perspective views of the registration system are seen in FIGS. 11, 12 and 13, which show two or three registration fingers 115 on either side of registration pinch rolls 113. The pinch rolls 113 are movable into and out of engagement with coacting drive rolls 114 (FIG. 5) and the fingers 115 are movable between an operative position in which their tips 116 project through slots 115*a* in the outer guide 29 into the sheet path and a retracted position raised out of the sheet path. The pinch rolls 113 and fingers 115 are operated in the following manner. Prior to the arrival of a sheet at the nip 30, the rolls 113, 114 are disengaged and the fingers 115 are moved to their operative positions. A sheet being driven by the takeaway rolls 94, 95 is deflected downwardly by the shaped portion 29*a* of the guide 29 against an opposed guide surface 30*a* (FIG. 5) which directs the lead edge of the sheet into the registration nip and against the tips 116 of the fingers 115. The surfaces 29*a* and 30*a* together form a buckle inducing chamber which enables the sheet to be overdriven against the fingers 115 so as to remove any skew from the sheet without the sheet creasing. Thus the sheet is caused to assume a smooth buckle as shown in FIG. 14. In order to feed the sheet to the photoreceptor 1 the pinch rolls 113 are engaged with the drive rolls 114 following which the registration fingers 115 are retracted. The drive rolls 114 are then energised to feed the sheet in synchronous relation to the devloped image on the photoreceptor.

The registration fingers 115 are actuated through a series of linkages by a registration solenoid 117. As the solenoid 117 is energised, cranked arm 118 rotates clockwise (as viewed in FIGS. 11, 12 and 13) about a fixed axis pivot pin 119 that is mounted on a support 120 of a pair of supports 120, 140 for the guide 29. At its upper end, the arm 118 carries an actuating pin 121 which moves along a slot 122 in a link 123, causing link 123 to move anticlockwise about the axis of rod 124. Link 123 is fixed to rod 124, so rod 124 also makes an anticlockwise angular movement. This in turn causes the tips 116 of registration fingers 115 to move down through the slots 115a in outer guide 29, and into the paper path. As shown in FIG. 12, a link 125 is fixed to rod 124, and carries at its end remote from rod 124 a pin 126. Pin 126 is fixed to link 125, but is pivotally mounted in registration finger 115. The end of rod 124 which passes through link 125 is located in a slot formed in the end of finger 115 remote from its tip 116. As seen in FIG. 12, the upper part 127 of finger 115 adjacent rod 124 is relatively thin, to form a spring, the finger 115 bieng made of a suitable plastics material, such as Nylon. If, then, the registration fingers 115 are lowered onto a sheet of paper, the tips 116 press lightly on the paper, since the fingers 115 pivot about pins 126 against the spring action of upper parts 127.

As the registration fingers 45 are lowered, the registration pinch rolls 113 are raised. As already described, on energisation of solenoid 117, actuating pin 121 moves in an upward arc. This in turn raises and moves to the right the right hand end of a link 128 on the other side of support 120. The left hand end of link 128 is pivotally mounted on the upper end of a lever 129 that is pivotally mounted on rod 124. Hence lever 129 makes a clockwise angular movement. The lower end of lever 129 is fixed to a generally rectangular resilient support bracket 130 which carries at its upper edge the axle 131 of registration pinch rolls 113. As lever 129 moves clockwise, the rolls 113 are lifted away from the registration drive rolls 114 (FIG. 5) with which they cooperate through slots 113a in the outer guide 4. The rolls 113 are loaded against the rolls 114 by a spring 132 (FIG. 11). The The various linkages are so arranged that in the first part of the movement produced by energisation of solenoid 117, the registration fingers 115 move downwards before the rolls 113 are raised. Conversely, on de-actuation of the solenoid, the rolls 113 are lowered before the registration fingers 115 are raised.

The registration solenoid 117 is energised from a signal initiated by the sensor switch 96 which is actuated by paper moving around the outer guide 29. The action of registration solenoid 117 on energisation is to move the registration fingers 115 into the paper path and to open the nip between the registration pinch rolls 113 and the drive rolls 114. A spring 133 returns the solenoid 117 to its inactive position and causes the registration mechanism to be reset to close the nip and retract the fingers.

The paper sheet is driven into the registration position, i.e. with its leading edge in contact with the registration fingers 115, by the takeaway rolls 94, 95 and a small buckle is formed in the sheet by means of the buckle inducer 29a, 30a. A timed signal from the machine logic then deactuates the solenoid 117 which is returned by the spring 133. As the solenoid deactuates, the pinch rolls 113 close onto the paper, and the registration fingers 115 are then raised from the paper path, allowing the paper to be transported to the photoreceptor as soon as the drive rolls 114 are rotated.

Once the paper is being transported by the photoreceptor, and then by the pre-fuser transport 5, the solenoid 117 is reactued for the second sheet. This raises the pinch rolls 113, and lowers the registration fingers 115. However, the latter are arrested by the sheet which is still moving through the registration nip and rest lightly on the moving sheet. As the trail edge of the sheet exits the nip 30, the fingers drop into the gap between that sheet and the next sheet to register the second sheet. This sequence enables the intersheet gap to be reduced to a minimum thus increasing the copy sheet throughput. It will be understood that for a sheet to be acted upon in this way it needs to be longer than the distance between the rolls 113, 114 and the next drive device (vacuum transport 9) since the rolls 113, 114 cannot be separated until the lead edge of the sheet has been picked up by the next transport device.

A slightly modified form of spring-loaded finger 115 is shown in FIGS. 13 to 15. As best seen in FIG. 15, the finger comprises a plastics moulding 133 carrying the tip 116, which is mounted for rotation about the shaft 124. A blade 134 rigidly attached to the shaft 124 engages beneath a shoulder 135 of the moulding 133 and is pressed against the shoulder by a light spring 136 seated on a portion of the moulding opposite the shoulder 135. When the finger is lowered against a sheet, the moulding 133 rotates about the shaft 124 against the spring action. When the trail edge of the sheet has passed the finger, the molding is urged by the spring 136 so that the tip 116 drops down behind the sheet.

As has been just explained, the registration arrangement 30 permits the intersheet gap to be kept to a minimum. In order to take advantage of this feature the sheet feeder 28 must be able to feed sheets at closely spaced intervals. This is achieved by means of a wait station defined by the retard nip 102, 103 and the wait station sensor 97. As is conventional with this type of feeder, it must be switched off before the trail edge of a sheet being fed exits the retard nip so as to avoid stream-feeding. With the specific feeder described, the lead edge of the next sheet to be fed will normally be waiting in the retard nip but sometimes (about 10% of the time) the next sheet's lead edge will be somewhere between the stack and the nip. In order to maximise the throughput it is important that the intersheet gap be uniform and in order to achieve this the wait sensor 97 senses the absence of a sheet in the retard nip and reactuates the sheet feeder until the next sheet's lead edge has entered the nip. Thus the lead edges of all sheets (except the first sheet) in a cycle will be fed from the same point (the retard nip) and the intersheet gap will be uniform. By positioning the wait station at the retard nip, operation of the feeder to advance the next sheet into the wait station is only required when there is no sheet waiting at the nip.

Operation of the sheet transport to feed a sequence of sheets from one of the trays 26 or 27 will now be described. The selected tray is positioned against the feeder 28 in the manner described above and the operator selects the required number of copies and signals the start of the copying by pressing the 'start-print' button of the copier or initiating the start of an automatic document feeder.

Sheets may be fed at two different speeds depending upon the process speed of the copier. Thus the copier may operate at different copying rates depending upon the way documents are being copied. In particular, where an automatic document handler is provided and the optical system may be operated in a stationary mode in which documents are fed one at a time past the optical system (by the document handler) to expose them or in moving mode in which stationary documents are multiply exposed by scanning the optical system across the document, a higher copy rate may be achieved in the former mode.

The first sheet in a sequence feeds straight through the retard nip and is picked up by the feed rolls 90, 91 which are going slightly faster than the belt 102. When the lead edge of the sheet has entered the intermediate take-away nip rolls 94, 95 it triggers the input microswitch 96 which turns off the feeder 28. At the same time the wait station sensor 97 is interrogated by the copier's microprocessor to see if it can detect a sheet present. If it cannot at this time it sets the lower copy rate based on the expectation either of at transparency (of which it cannot detect the edges and therefore cannot control in the same way an an opaque copy) or a failed sensor.

The sheet is further fed by the take-away rolls, 94, 95 up against the registration fingers 115 for a time sufficient to form a slight buckle in the sheet ensuring any skew is overcome. The intermediate rolls 94, 95 are then switched off and the solenoid 117 is released which closes the registration nip rolls 113, 114, which are stationary, and then lifts the fingers 115 out of the paper path. The registration nip rolls are actuated to drive the sheet into engagement with the photoreceptor 1 by a microswitch (not shown) in the machine optics (moving optics mode) or in the document handler (fixed optics mode). A timed interval after sheet drive is initiated and when the sheet has been picked up by the vacuum transport 9 the solenoid 117 is deactivated so that the registration pinch rolls 113 separate from the drive rolls 114 and the finger 115 are lowered onto the sheet so that when the trail edge of the sheet leaves the registration nip, the tips 116 of the fingers 115 drop down behind the sheet into the paper path ready to register the next sheet.

The input microswitch 96 senses the trail edge of an opaque sheet and a timer senses the time between the registration nip rolls starting up and the trail edge sensing by the microswitch. This enables the length of the sheet to be determined and sets the copy rate for subsequent sheets. For A4 and less it will be 40 cpm, for larger sheets 35 cpm. The higher speed feeding of A4 and smaller sheets is possible due to the provision of the wait station which operates as follows. When the trail edge of a sheet leaves the retard nip, the wait sensor 97 detects whether or not the next sheet is already in the retard nip and if necessary actuates the nudger/feeder 28 to a advance the next sheet to the wait station (retard nip) whereupon the feeder is shut off again. The amount of sheet movement necessary will depend on the position of the next sheet which may be anywhere between the stack and just ahead of the nip, depending upon the drag exerted by the previous sheet. With this arrangement the position of the sheet lead edge is closely controlled and the intersheet gap can be kept to a minimum without wide variations causing the gap to become too small to permit the input microswitch 96 to detect the gap and the registration fingers to fall into the gap.

In order to positively drive sheets through the transport path, the various drive nips of the feeder 28 (belt and roll 102, 103 and feed rolls 90, 91) take-away rolls 94, 95 and registration rolls 113, 114 firmly grip the sheets. So as to facilitate the removal of jammed or stalled sheets from the transport, a mechanism is provided for automatically disengaging the drive nips when the trays 26, 27 are lowered to their loading positions. Lowering of the trays is effected as described above when the access door is opened. Lowering of the trays could also be effected directly in response to the sensing of a jam but preferably a jam or stalled sheet condition is indicated visually to the operator who can then open the access door so effecting lowering of the trays and thus operation of the nip disengaging or splitting mechanism.

The nip splitting mechanism is seen in FIGS. 11 and 16 to 18 and is actuated by means of a projection 141 on the paper tray carriage. Opening the front access door causes the paper tray carriage to be lowered, so cable 142 attached to projection 141 is pulled down. This rotates capstan 143, to which the ends of cable 142 (which passes over pulleys 166, 167) are connected, anti-clockwise as viewed in FIG. 16 or 17. Capstan 143 is mounted on a shaft 144 which carries at its other end a cam member 145. Cam member 145, which has at its upper end a cam surface 146, makes an anti-clockwise angular movement with shaft 144. The cam surface 146 of cam member 145 engages the underside of the mounting block 112 carrying the retard roll 103 and the feed rolls 90. The block 112 indicated in simplified diagramatic form in FIG. 16, is pivotally mounted about pivot pins 112*a*. The cam surface 146 is shaped so that anti-clockwise movement of the member 145 lowers the friction retard roll 103 out of contact with the retard belt 102 and at the same time disengages the feed roll 90 from the feed roll 91, the upward movement of the spring 99 (FIG. 10) being arrested by shoulders 147 on the block 112 as the latter is lowered. At its lower end, cam member 145 has a lever portion which carries an actuating pin 148. This pin is moved anti-clockwise by the rotation of the shaft 144, causing an arm 149 which has an arcuate surface 150 that is engaged by the pin 148 to be displaced to the right. The arm 149 extends upwards and branches out to form a Y-shaped yoke member, the two arms 151 of which are pivotally mounted at their upper ends, by means of shaft 152, extending between the supports 120, 140. Movement of arm 149 to the right causes the upper ends of arms 151 to move down, and the central parts of arms 151 to move away from the outer guide 29. Pinch roll 94 of the take-away roll pair 94, 95 is mounted by means of a shaft 154 loosely held in slots 154a in the arms 151 and which is spring loaded against the roll by a pair of leaf springs 155 connected to a bracket 156 secured to the supports 120, 140. As the arms 151 move away from the outer guide 29, the shaft 154 is also moved away, so that the nip between take-away rolls 94, 95 is broken.

A cross-bar 153 connecting the upper ends of arms 151 engages the rear end of the pivotally mounted support 130 for the registration pinch rolls 113 so that as the cross-bar 153 is depressed the support 130 is rotated anticlockwise to lift the pinch rolls 113 out of engagement with the registration drive rolls 114. To permit this without affecting the registration mechanism, a slot 128*a* is formed in the lever 128 (FIG. 13).

As explained above, there will usually be one or more sheets partly advanced off the stack into the retard nip and when the tray which was in use is lowered one or more sheets may be retained in the retard nip. If is normally desirably and, where the trays are to be changed over for feeding different paper, it is essential that such sheet(s) be returned to the tray. Accordingly apparatus is provided as shown in FIGS. 16, 17, 19 and 20 for urging such sheets back into the respective tray when the trays are lowered. The sheet return apparatus comprises a pair of pusher fingers or arms 163 pivotally mounted on pins 164 carried by the transport frame. The lower ends of the fingers 163 are connected by a shaft 162 which also carries an arcuate actuator arm 160 having a longitudinal slot 161 engaged by the actuating pin 148. As the actuating pin 148 moves to the right during lowering of the tray carriage (and opening of the drive nips) it engages the end of the slot 161 and causes the fingers 163 to rotate anticlockwise about their axes 164 so that their tips emerge through slots 165 (FIG. 19) in the guide 29 and press against the lead edges of any sheets which have been partially forwarded from the tray to push such sheets back into the tray.

The purpose of the slots 161 in the actuator arm 160 is to ensure that the fingers 163 do not engage the sheets until the retard nip 102, 103 has been split by movement of the cam 145, rotation of which has completed the nip splitting operation by the time the pin 148 engages the end of slot 161, further rotation of the cam not materially affecting the nips.

In its end position with the nips fully split and the fingers 163 fully extended the cam is positioned horizontally as seen in FIG. 20 with the actuating pin 148 engaged in a notch 150*a* (FIG. 16) in the surface 150 so that premature reengagement of the nips is prevented.

When the tray carriage is raised again, the shaft 144 is rotated clockwise by the cable 142. As a result the cam 145 is also rotated clockwise so that the retard roll block 112 is lifted to reengage the retard and feed roll nips 102, 103, and 90, 91 and the yoke member 149 is returned to reengage the take-away nip 94, 95 by spring 132 on the registration pinch roll support 130 which thus also reengages the registration nip.

Of course, while disengagement and reengagement of the registration nip rolls 113 has been discussed it will be understood that when the trays are lowered the registration nip rolls may already be disengaged in which case the movement of yoke member 149 will not affect the registration pinch rolls 113. Prior to the feeding of the first sheet following raising of the trays the registration pinch rolls 113 will always be separated and the registration fingers 115 inserted in the sheet path. This may be performed while the trays are lowered.

It will be remembered from the foregoing that the elevation of the tray 26 or 27 from which sheets are being delivered will depend upon the height of the stack in the tray. Accordingly, the tray carriage will be lowered and raised by differing amounts. This in turn will cause the degree of rotation of cam 144 to vary. In order to ensure that the shaft rotates through a fixed arc both during lowering and raising of the tray carriage, the cam 145 is rotatable on the shaft 144 and is driven through a pair of wrap spring clutches 157, 158, which respectively operate the cam in opposite directions. The clutch 157 is is initially engaged during tray lowering to give approximately 90° anticlockwise rotation of the cam before a tang on the wrap spring engages a stop causing the wrap spring to disengage so that the cam is unaffected by further rotation of the shaft 144. The second clutch 158 which is arranged oppositely to the clutch 157 on the other side of the cam operates so as to connect cam 145 and shaft 144 only during a fixed approximatey 90° clockwise rotation of the cam.

As explained above, the drive for the nip separation mechanism is through a cable 142 which is wound around a capstan 143. As shown in FIG. 21, the capstan 143 is constructed in such a way as to permit adjustment of the cable tension. Thus, the the capstan is constructed in two parts 171, 172 one of which (171) is fixed for rotation with the shaft 144 and the other of which (172) is rotatable on the shaft. The two parts are urged together by a spring 173 and their mating faces are formed with cooperating ratchet teeth which prevent the rotatable part 172 from unwinding. By relatvely rotating the parts with the ratchet teeth riding over each other slack in the cable can be taken up and by separating the parts by pulling part 172 against the spring 173 it can be unwound to slacken the cable for servicing of the nip mechanism. To assist the manipulating the capstan, the parts 171, 172 are provided with and grip parts 171*a*, 172*a*. The parts 171, 172 are shown slightly separated in FIG. 21.

To reduce the risk of a flat being worn on the retard roll 103 during continued operation of the feeder, the retard roll is rotated through a small angle every time the paper tray carriage 40 is lowered, i.e. each time the front access door is opened or the trays are changed over. To this end the retard roll 103 is mounted on a shaft for rotation in the anticlockwise direction only with a ratchet 160 (FIG. 10) which is engaged by a pawl 161 attached to the leaf spring 99 carrying the feed rolls 90. As mentioned previously when the retard roll assembly is retracted, the spring 99 lifts against the stops 147. During this movement the pawl indexes the ratchet anticlockwise through about 15°. When the retard roll assembly is lifted again the spring 99 is pushed downwards as rolls 90 engage rolls 91 and the pawl 161 overrides at least one ratchet tooth to ready it for the next indexing movement when the retard roll assembly is again lowered.

Sheets advanced by the registration nip rolls 113, 114 to the photoreceptor receive an image at the transfer station and are then stripped from the photoreceptor, their lead edges being picked up by the pre-fuser vacuum transport 9. The vacuum transport, like the guide 29, is arranged so that sheets being conveyed along it overlap the front side edge to facilitate removal of jammed or stalled sheets. The transport 9 consists of a set of five endless belts arranged for circulating movement around rollers mounted at the ends of a vacuum chamber. The vacuum chamber has a set of ports in its upper surface, between the belt runs. The vacuum is applied through these ports to hold the copy sheet down onto the belts. As the leading edge of the copy paper travels along this transport, the influence of the vacuum reduces thus allowing the paper to enter the fuser in a free state. This is achieved by the positioning of the vacuum ports towards the input end of the transport.

The transport system is also used to draw ozone away from the drum area and exhaust it into the ozone filter fitted below the main tray assembly. The vacuum is obtained by a blower fitted to the rear of the vacuum penum chamber. Exhaust from this motor is directed into the ozone filter.

From the vacuum transport 9 sheets pass through the fuser 10 and between a pair of feed-out guides 31 which are also arranged so that sheets overlap the front side edge to facilitate removal of jammed or stalled sheets. The paper transport output guides 31 direct paper from the fuser to the machine output station (e.g. catch tray 32) by way of corrugated feed rolls. The guides are "open faced" to reduce the risk of paper jams caused by condensation, and carry a copy count switch, and a passive static eliminator. The copy count switch monitors the number of copies entering the output station, for billing purposes.

Although a specific embodiment has been described hereinabove it will be realised that various modifications may be made to the specific details referred to without departing from the scope of the invention as defined in the appended claims.

Although the apparatus described above has two paper trays, it may equally have three or more paper trays. In these circumstances, all the trays except the lowermost tray need to be of the kind referred to above as the main tray, i.e. of the kind including a sub-frame and a tray mounted for left-to-right movements across the sub-frame. Furthermore, the lower-most tray (of any number of trays) need not necessarily be of the kind described above as the auxiliary tray. It, too, may be of the same kind as the main tray, with a tray slidably mounted on a sub-frame.

It is to be understood that while reference is made herein to drive nips along the sheet transport which have one driver roll, one or more such nips could be provided which comprise pairs of coacting idler rolls.

It is to be understood that although in the copier illustrated only the transport 25 has the parts at one side thereof mounted off the rear frame only to increase accessibility to the paper path, other sections of the paper path may be constructed in this way and indeed the entire paper path may be so constructed thus avoiding any bridges or interruptions across the front side of the paper path.

What is claimed is:

1. A sheet transport including one or more drive nips and means for automatically disengaging said nip(s) in response to a predetermined condition, said sheet transport including a tray for a stack of sheets and means for feeding sheets one at a time from the tray, said tray being moveable between a sheet feeding position and a retracted position and having a projection therefrom that is attached to a cable mounted over a series of pulleys and a capstan, said capstan is mounted on one end of a shaft which has a cam member mounted on its other end such that movement of said tray to a retracted position causes said capstan and said cam member to rotate and thereby actuate said means for automatically disengaging said nip(s).

2. The sheet transport according to claim 1, wherein said cam member has a surface thereof shaped to engage the underside of a mounting block which carries the lower portions of said drive nip(s) such that anti-clockwise movement of said cam member disengages said lower portion of said drive nip(s).

3. The sheet transport according to claim 2, wherein said cam member has a lever portion at its lower end which carries an actuating pin, anti-clockwise rotation of said shaft causes said actuating pin to displace an arm member, said arm member having portions thereon that form a Y-shaped yoke member that moves to disengage at least one of said drive nip(s) due to the rotation of said shaft.

4. A copier including a housing having multiple sides, a tray positioned within said housing for supporting a stack of sheets, a sheet transport for conveying sheets from the tray, said transport including one or more drive nips, a door positioned within one of said sides of said housing and adapted upon opening to initiate movement of said tray to a retracted position, means for disengaging said nips, and means connected to said tray and adapted such that movement of said tray actuates said means for disengaging said nips.

* * * * *